United States Patent [19]

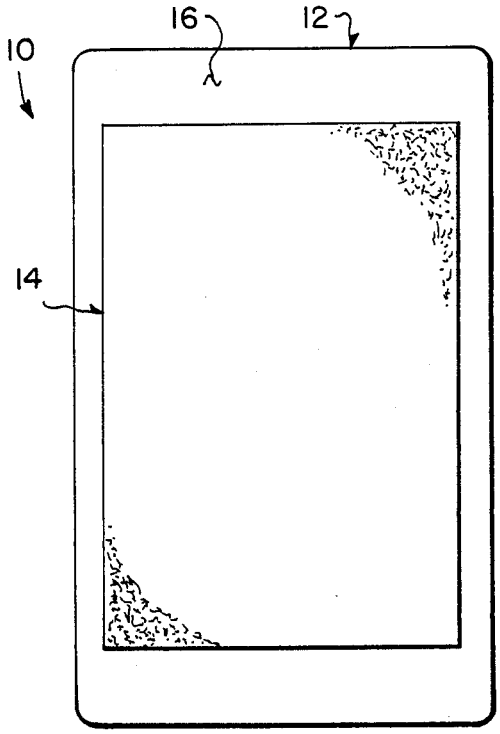
Fig. 1
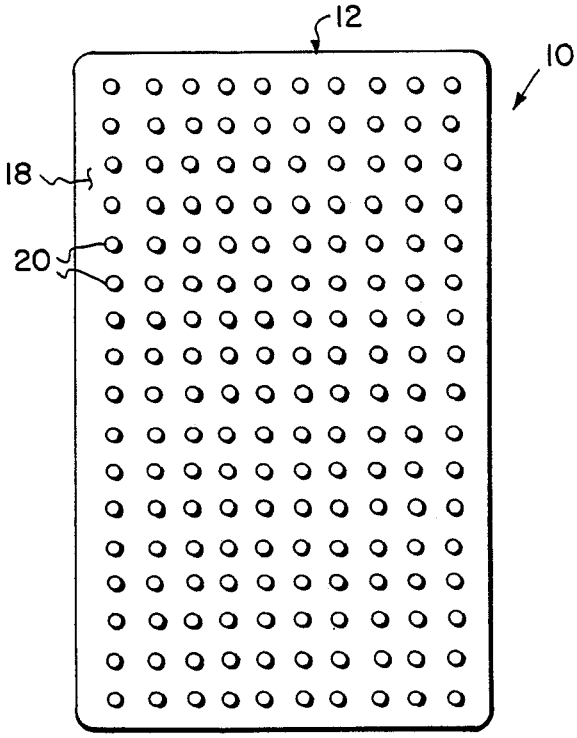
Fig. 2
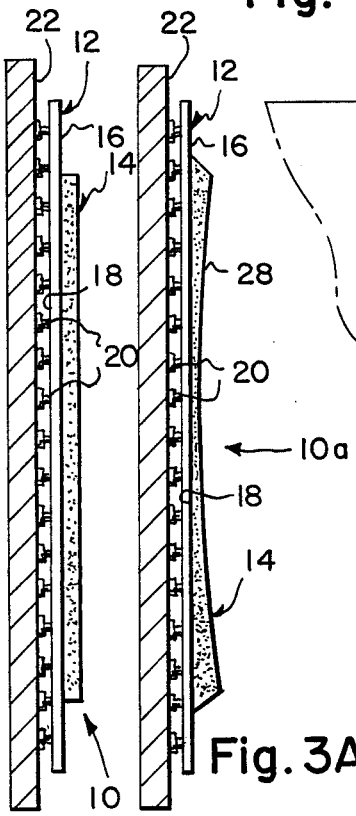
Fig. 3A
Fig. 3
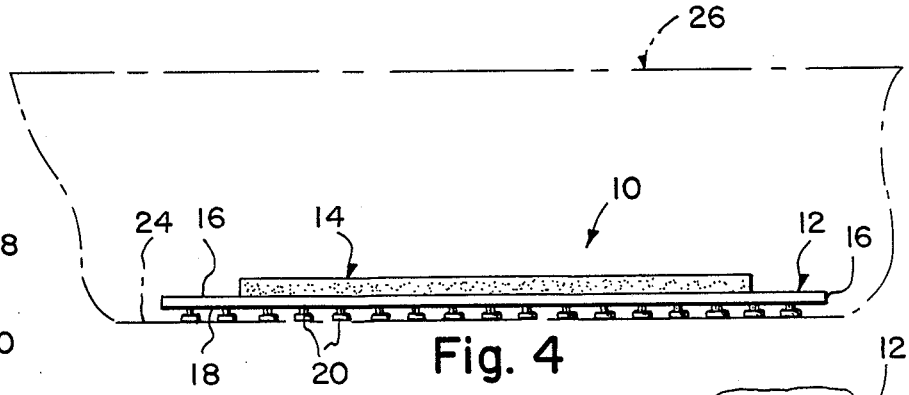
Fig. 4
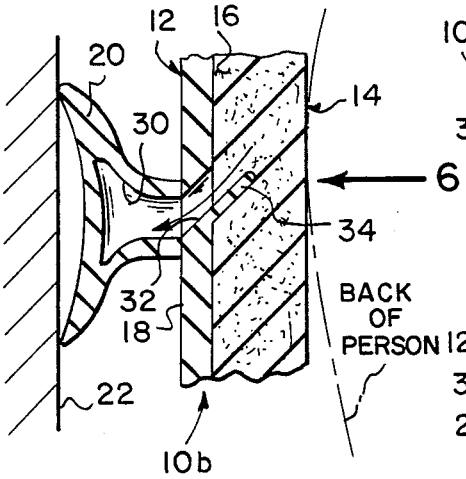
Fig. 5
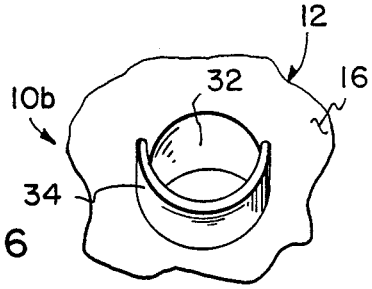
Fig. 6
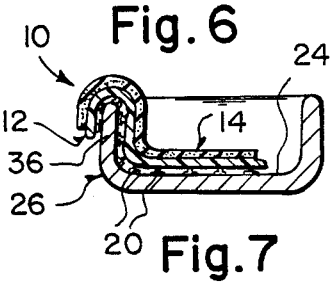
Fig. 7

Stowers et al.

[11] Patent Number: 4,890,352

[45] Date of Patent: Jan. 2, 1990

[54] BACKWASHER

[76] Inventors: George E. Stowers, 720 St. Marks Ave., 3f, Brooklyn, 11216; George Spector, 233 Broadway, Rm. 3815, New York, both of N.Y. 10007

[21] Appl. No.: 231,253

[22] Filed: Aug. 11, 1988

[51] Int. Cl.[4] ..... A47K 7/03

[52] U.S. Cl. ..... 15/244.1; 15/160; 4/606

[58] Field of Search ..... 15/160, 110, 244.1; 4/605, 606

[56] References Cited

U.S. PATENT DOCUMENTS 1,954,940 4/1934 Mikel ..... 15/110 X 3,289,215 12/1966 Kennedy ..... 15/160 X

*Primary Examiner*—Harvey C. Hornsby

*Assistant Examiner*—K. O'Leary

[57] ABSTRACT

A back washer is provided and consists of a sponge rubber washing member affixed to a flat flexible rubber base plate that is removably mounted to a flat surface so that a person can wash their back against the washing member when in shower and bathtub.

2 Claims, 1 Drawing Sheet

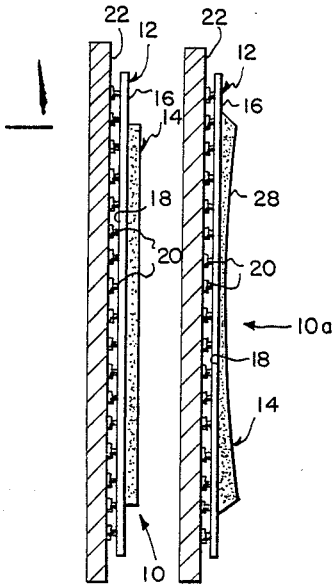

BACKWASHER

BACKGROUND OF THE INVENTION

The instant invention relates generally to bathing implements and more specifically it relates to a back washer.

Numerous bathing implements have been provided in prior art that are adapted to aid people when washing in the shower or bathtub, such as brushes, scrubbers or the like. While these units may be suitable for the particular purpose to which they address, they would not be as suitable for the purposes of the present invention as heretofore described.

SUMMARY OF THE INVENTION

A primary object of the present invention is to provide a back washer that will overcome the shortcomings of the prior art devices.

Another object is to provide a back washer that can be removably affixed to a shower wall or bathtub so that a person can wash their back.

An additional object is to provide a back washer that is structured to retain a portion of the liquid soap that is applied thereto so that a person can press their back against the washer to squeeze out the liquid soap when washing their back.

A further object is to provide a back washer that is simple and easy to use.

A still further object is to provide a back washer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front view of the invention.

FIG. 2 is a rear view thereof.

FIG. 3 is a side view of the back washer removably affixed to a shower wall.

FIG. 3A is a side view similar to FIG. 3, of a concave back washer.

FIG. 4 is a side view of the back washer removably affixed into a bathtub.

FIG. 5 is an enlarged side cross sectional view of a modification in which the suction cup can retain some of the soap therein.

FIG. 6 is a front view taken in direction of arrow 6 in FIG. 5 with sponge removed so that the curved rigid lip can be seen about the angular hole.

FIG. 7 is a cross sectional view of the back washer mounted over the ledge of a bathtub.

DETAILED DESCRIPTION OF THE PREFERRED EMBODIMENTS

Turning now descriptively to the drawings, in which similar reference characters denote similar elements throughout the several views, FIGS. 1, 2, 3 and 4 illustrate a back washer 10, that consists of a flat flexible rubber base plate 12 and a sponge rubber washing member 14 that is affixed to front surface 16 of the base plate 12. Rear surface 18 of the base plate 12 is provided with a plurality of suction cups 20 formed thereon which will stick to a flat surface such as a shower wall 22 or bottom

24 of a bathtub 26 and be removably mounted thereto. A person (not shown) can wash their back against the washing member 14 when in a shower and bathtub.

FIG. 3A shows a modified back washer **10*a* in which the front surface 28 of the washing member 14 is concave to conform to the back of the person using the back washer 10**.

Another modified back washer **10*b* is shown in FIGS. 5 and 6, each of the suction cups 20 has a hollow chamber 30 therein. The base plate 12 has a plurality of rearwardly angular holes 32. Each hole 32 is fluidly connected to the hollow chamber 30 of each of the suction cups 20. A curved rigid lip 34 is formed about each of the angular holes 32 to guide some liquid soap that is applied onto the washing member 14 into the hollow chamber 30 of the suction cups 20 so that when a person presses their back against the washing member 14 the liquid soap will be squeezed and pushed out into the washing member 14** to help wash the back of the person.

As shown in FIG. 7, the back washer 10 can also be placed into the bathtub 26 in which a portion thereof is mounted over the ledge 36 so that a person sitting in the bathtub 26 can better utilize the back washer 10 when washing their back.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A backwasher which comprises:

(a) a flat flexible rubber base plate having a front washing surface and rear surface;

(b) a sponge rubber washing member affixed to said front washing surface of said base plate;

(c) means for removably mounting said rear surface of said base plate to a flat surface so that a person can wash their back against said washing member when in shower and bathtub, wherein said removably mounting means is a plurality of suction cups formed on the rear surface of said base plate which will stick to the flat surface;

(d) each of said suction cups having a hollow chamber therein;

(e) said base plate having a plurality of rearwardly angular holes, each fluidly connected to said hollow chamber of said suction cups; and (f) a plurality of curved rigid lips, each formed about each of said angular holes to guide some liquid soap that is applied onto said washing member into said hollow chamber of said suction cups so that when a person presses their back against said washing member, the liquid soap will be squeezed and pushed out into said washing member to help wash the back of the person.

2. A back washer comprising:

(a) a sponge water and soap absorbing member having a front washing surface, and a rear mounting surface;

(b) mounting means secured to said mounting surface adapted to secure said member to a support such as a tub and shower wall;

(c) said mounting means including means for injecting liquid soap into said washing member responsive to pressure against said washing surface by a user.

* * * * *